US007828468B2

(12) United States Patent
Mayfield, III et al.

(10) Patent No.: US 7,828,468 B2
(45) Date of Patent: Nov. 9, 2010

(54) LOUVER ASSEMBLY FOR A LIGHT FIXTURE

(75) Inventors: John Thomas Mayfield, III, Loganville, GA (US); Stephen Haight Lydecker, Snellville, GA (US); Charles T. Faircloth, II, Covington, GA (US)

(73) Assignee: Acuity Brands, Inc., Atlanta, GA (US)

( * ) Notice: Subject to any disclaimer, the term of this patent is extended or adjusted under 35 U.S.C. 154(b) by 506 days.

(21) Appl. No.: 11/766,241

(22) Filed: Jun. 21, 2007

(65) Prior Publication Data

US 2007/0297181 A1 Dec. 27, 2007

Related U.S. Application Data

(60) Provisional application No. 60/815,705, filed on Jun. 22, 2006.

(51) Int. Cl.
*F21S 8/04* (2006.01)

(52) U.S. Cl. ..... 362/342; 362/217.03; 362/217.05; 362/225

(58) Field of Classification Search ..... 362/342, 362/147, 148, 150, 217.03, 217.05, 241, 362/290, 292, 396, 225
See application file for complete search history.

(56) References Cited

U.S. PATENT DOCUMENTS

| | | | | |
|---|---|---|---|---|
| D122,861 | S | | 10/1940 | Carter, Jr. |
| D128,961 | S | | 8/1941 | Hrabak |
| D132,144 | S | | 4/1942 | Hallman |
| D143,641 | S | | 1/1946 | Biller et al. |
| D155,306 | S | | 9/1949 | Meyer |
| D156,332 | S | | 12/1949 | Gilman |
| D160,417 | S | | 10/1950 | Nitardy |
| 2,565,741 | A | | 8/1951 | Runge |
| 2,606,998 | A | | 8/1952 | Wyman et. al. |
| 2,621,285 | A | * | 12/1952 | Nitardy ..... 362/225 |
| 2,670,429 | A | | 2/1954 | Tillson |
| 2,683,799 | A | * | 7/1954 | Taylor et al. ..... 362/260 |
| 2,946,880 | A | | 7/1960 | Picha et. al. |
| D209,534 | S | | 12/1967 | Eisenberg |
| D240,853 | S | | 8/1976 | Aronson |
| 4,268,897 | A | * | 5/1981 | Schierwagen et al. ..... 362/325 |
| 4,494,175 | A | | 1/1985 | Gawad et al. |
| D300,873 | S | | 4/1989 | Thompson et al. |
| 4,849,867 | A | | 7/1989 | Glass et al. |
| 4,967,324 | A | | 10/1990 | Barclay |
| 5,117,342 | A | | 5/1992 | Vlah |
| D329,102 | S | | 9/1992 | Dieperink |
| 5,303,507 | A | | 4/1994 | Oille |

(Continued)

FOREIGN PATENT DOCUMENTS

| | | |
|---|---|---|
| CA | 123993 | 11/2008 |

(Continued)

*Primary Examiner*—Sharon E Payne
(74) *Attorney, Agent, or Firm*—Ballard Spahr LLP

(57) ABSTRACT

A louver assembly is disclosed for use in an overhead lighting system. The louver assembly comprises a series of thin, light-weight stringers and blade ribs arranged perpendicular to one another such that the respective side surfaces of the respective stringers are positioned at an acute angle with respect to a ceiling plane and the reflective faces of the blade ribs are positioned substantially transverse with respect to the ceiling plane.

39 Claims, 12 Drawing Sheets

U.S. PATENT DOCUMENTS

| | | | | |
|---|---|---|---|---|
| D360,271 | S | 7/1995 | Butler | |
| D365,409 | S | 12/1995 | Lu | |
| D378,860 | S | 4/1997 | Galletly | |
| 5,803,585 | A | 9/1998 | Littman et al. | |
| 5,806,972 | A | 9/1998 | Kaiser et al. | |
| 5,823,663 | A | 10/1998 | Bell et al. | |
| 6,138,416 | A * | 10/2000 | Platt | 52/28 |
| 6,582,098 | B1 | 6/2003 | Brown et al. | |
| D480,168 | S | 9/2003 | Herst et al. | |
| D485,932 | S | 1/2004 | Crane | |
| D520,176 | S | 5/2006 | Herst et al. | |
| 7,036,957 | B2 | 5/2006 | Paravantsos | |
| 7,108,398 | B2 | 9/2006 | Holten | |
| 7,390,111 | B2 * | 6/2008 | Lippis | 362/396 |
| 2007/0195531 | A1 * | 8/2007 | Paravantsos | 362/282 |

FOREIGN PATENT DOCUMENTS

| | | |
|---|---|---|
| GB | 2060212 | 2/1997 |
| GB | 2091915 | 4/2000 |

* cited by examiner 28
26

28
26

28
26

28
26

28
26

28
26

28
26

28
26

28
26

28
26

LOUVER ASSEMBLY FOR A LIGHT FIXTURE

This application claims priority to and the benefit of U.S. Provisional Application No. 60/815,705, filed on Jun. 22, 2006, which is incorporated in its entirety in this document by reference.

FIELD OF THE INVENTION

The field of this invention relates generally to lighting fixtures, and more particularly to a louver assembly for use therein.

BACKGROUND

Fluorescent lighting has long been commonplace especially in commercial, institutional and industrial applications. The energy efficiency of fluorescent fixtures coupled with relatively low fixture costs cause fluorescent lighting to be the lighting of choice in most office situations as well as in numerous other task lighting applications. In commercial applications, overhead lighting systems are commonly found in buildings that utilize "dropped" or suspended ceiling grid arrangements, which are normally hung from the floor platforms of the story located immediately above. Typical overhead lighting systems comprise a light fixture housing, or troffer that is conventionally designed in the shape of shallow, inverted, rectangular box having one open face. A series of light fixture housings or troffers are usually installed in the dropped ceiling grid, with each troffer carrying at least one light source, such as a tubular lamp, therein.

Oftentimes, a transparent or translucent lens may be used to cover the open face of the light fixture housing. Such lenses can be undesirable if they are not particularly designed to effectively prevent the escape of low angle light rays from the light fixture housings. These low angle light rays may create a glare that can be irritating to those individuals located in the space that the overhead lighting systems are designed to illuminate.

Accordingly, the use of either coffers or louvers has been proposed in the past for eliminating or minimizing glare. Conventional coffers are rectangular recesses formed in a ceiling at spaced intervals that are designed to house the light fixture housings. In order for a coffer to effectively reduce glare, it must have deeper dimensions than the light fixture housings that it will contain because the light fixture housings are usually installed in the upper surface or wall of the coffer, which allows the remaining side walls of the coffer to act as barriers to escaping low angle light rays. Though generally effective in reducing glare, coffers are often costly to install, and in certain instances, coffers may be impossible to install if the architectural design of the building prevents it.

Louvers help to reduce glare by directing the light radiating from the troffer generally downwardly. A typical louver comprises a grid-like structure that includes a series of V-shaped or parabolic shaped blades (or baffles) arranged perpendicular to one another and interlocked to form a series of more or less equally sized square or rectangular openings. Generally, louvers are mounted directly beneath the lighting tubes of light fixture housings, or troffers, such that the bottom edge of the louver is more or less flush with the plane of the ceiling.

A louver is typically assembled from a series of lateral and longitudinal metal blades. It has also been known to fabricate single-piece, plastic louvers using conventional injection molding techniques. Plastic louvers may be undesirable, however, because of deterioration that can result due to the louver blades proximity to light sources that generate substantial amounts of heat. Whether metal or plastic, the blades of most louvers are typically designed with parabolic side wall surfaces that are shaped to reflect the light emitted from the lamps downward in an effort to minimize the escape of the low angle light rays that produces glare. Typically, in order to create the parabolic shape for the blade side wall, the top edge surface of the blade is wider than the lower edge surface. This wide area along the blade upper edge surface acts to block a portion of the light emitted from the light source, i.e., lamp, and reflects it back into the light fixture, which negatively impacts the light fixture efficiency.

Louvered troffers generally set the standard in architectural lighting for most commercial and institutional applications and have become essential components of the very architecture of high activity environments. Thus, it is desirable to provide louvered fixtures which can be manufactured at minimum cost yet exhibit exceptionally high performance and provide a visually aesthetic appearance in their operating environment. Further, these low-cost, high performance louvered fixtures must be rapidly installable and must yield ever-increasing energy efficiencies while producing desired illuminance levels. Contemporary lighting systems and particularly louvered troffer systems must therefore provide a marriage of aesthetics and performance at minimum manufacturing costs.

SUMMARY

In response to the difficulties encountered in the prior art, a louver assembly is disclosed for use in an overhead lighting system. The louver assembly is disposed within a light fixture housing, just below one or more light sources, such as a tubular lamp. In one aspect, the louver assembly focuses the light radiated from the tubular lamp(s) in a downward direction.

In one embodiment, a plurality of blade ribs and a plurality of stringers are arranged perpendicular to one another to comprise the louver assembly. In one aspect, the stringers extend in the longitudinal direction, while the blade ribs extend in the transverse direction. The ribs and stringers are interconnected in a quick, easy, and secure manner to form the exemplified louver of the present invention.

Other apparatus, methods, and aspects and advantages of the invention will be discussed with reference to the Figures and to the detailed description of the preferred embodiments.

BRIEF DESCRIPTION OF THE DRAWINGS

The accompanying drawings, which are incorporated in and constitute a part of this specification, illustrate several aspects described below and together with the description, serve to explain the principles of the invention. Like numbers represent the same elements throughout the figures.

DETAILED DESCRIPTION OF THE INVENTION

Figure 1:
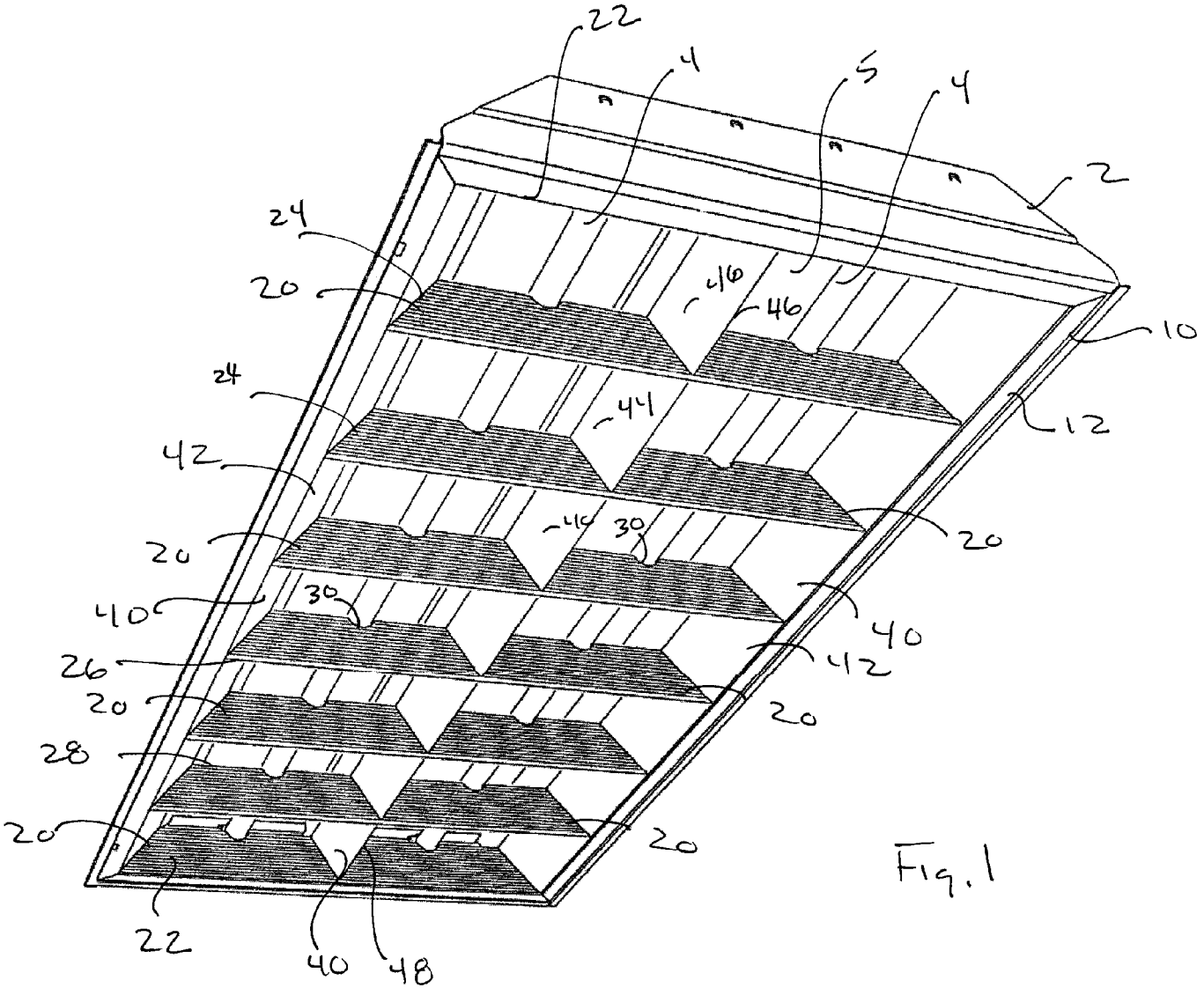
FIG. 1 is a perspective view of a louver assembly of the present invention shown disposed within a light fixture housing that is configured for mounting two lamp sources according to a first embodiment of the invention.
Figure 2:
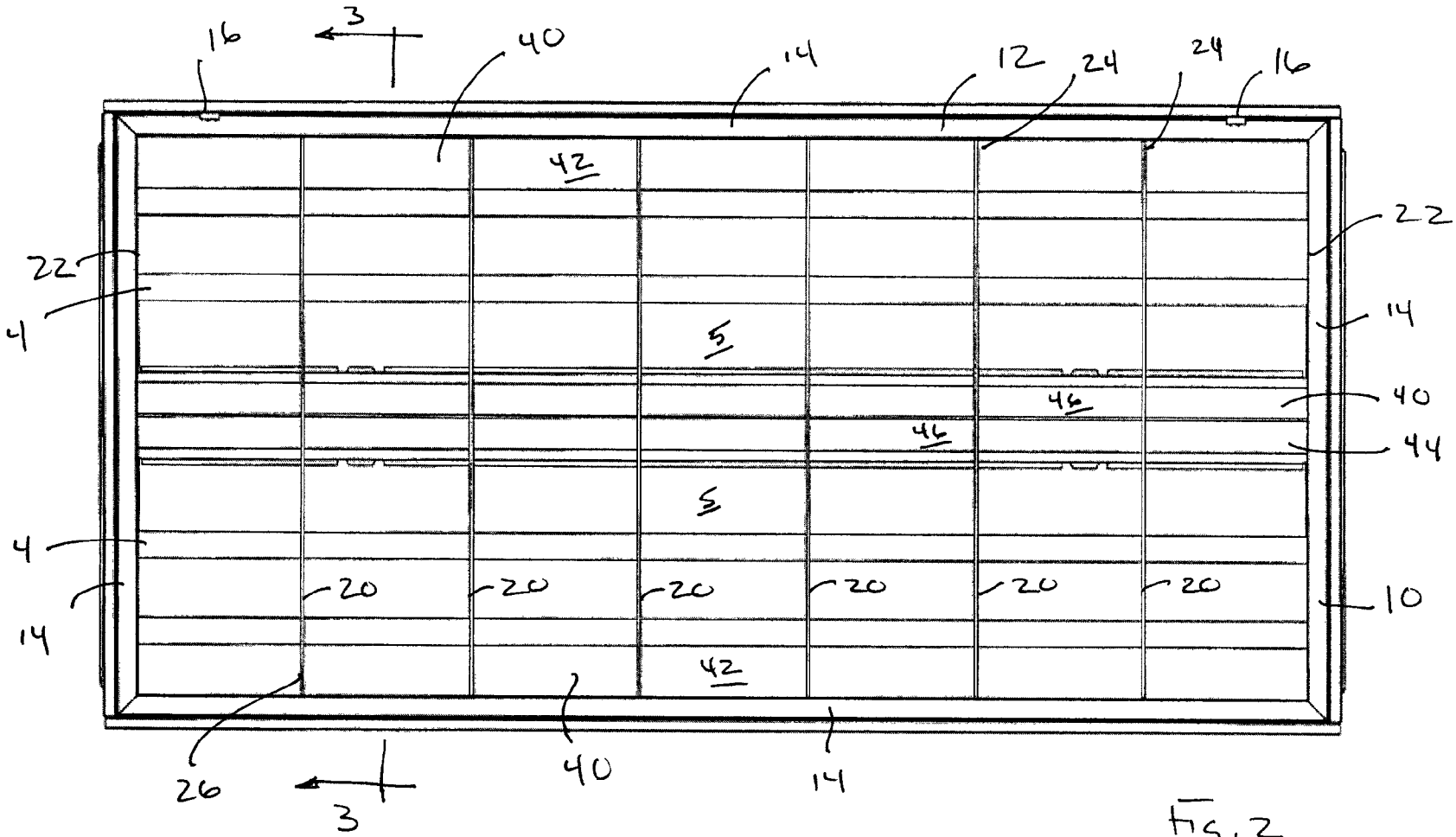
FIG. 2 is a bottom elevational view of the louver assembly of FIG. 1, shown disposed within the light fixture housing.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a blade rib" can include two or more such blade ribs unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "light fixture housing" may be used interchangeably throughout the specification with troffer, light fixture, light housing, fixture, luminaire, or housing, as is known in the art.

A louver assembly 10 is disclosed herein for use with an overhead lighting system in order to greatly reduce glare when illuminating commercial, office, institutional, or industrial spaces. Referring now to the drawings, and in particular to FIGS. 1-6, a first embodiment of the louver assembly 10 is mounted within a conventional light fixture housing 2, such that the bottom edges of both the louver assembly 10 and the light fixture housing 2 are more or less flush with one another, as well as with the plane of a ceiling (not shown). At least one light source, such as the exemplified pair of substantially parallel elongate tubular light lamps, are mounted to a base 5 of the light fixture housing and are disposed between the light fixture housing 2 and the louver assembly 10. However, it is contemplated that any conventional light sources can also be used, such as, without limitation, high lumen output electronic systems. In one aspect, the louver assembly of the present invention allows for the use of high lumen output electronic systems that would normally exhibit a loss of efficiency because of thermal effects on fluorescent output with traditional lensed troffer lighting fixtures. Further, it is contemplated that the exemplified louver assembly 10 can be configured, as one skilled in the art will appreciate, to accommodate one, two, three, or more elongated light sources 4 such as the exemplified tubular fluorescent lamps depending on the lighting performance desired or the size of the light fixture housing 2.

In one aspect, a plurality of blade ribs 20 and a plurality of stringers 40 are arranged perpendicular to one another to comprise the louver assembly. In one aspect, the stringers extend in the longitudinal direction, while the blade ribs extend in the transverse direction. In one exemplary aspect, the ribs and stringer can be interconnected in a quick, easy, and secure manner to form the exemplified louver of the present invention.

In one exemplified aspect, the louver assembly 10 comprises a door frame 12, the plurality of blade ribs 20 and the plurality of stringers 40, which are arranged perpendicular to one another to form a series of more or less equally-sized square or rectangular openings. In one aspect, the door frame comprised a plurality of elongate support members 14 that are connected together conventionally. In the illustrated example, four support members are connected together to form the generally rectangular door frame shown in FIGS. 1-6. Further, the louver assembly 10 can comprise a plurality of spring clips 16 that can be attached to edge portions of the support member forming the door frame. The spring clips are conventional and are configured so that the door frame can be releaseably connected to the light fixture housing. Of course, it is contemplated that other conventional means for releaseably securing the louver assembly of the present invention to the light fixture housing, such as screws, bolts, and the like, can be used.

In the exemplary embodiment illustrated in FIGS. 1-6, the plurality of blade ribs 20 comprises two end blade ribs 22 and six center blade ribs 24. In one aspect, each of the end blade ribs and center blade ribs can be substantially identical to each other. Further, each blade rib 20 has a lower edge 26 and an opposed upper edge 28 that is configured to be positioned proximate a portion of the base 5 of the light fixture. In one aspect, the lower edge of the blade rib can be positioned substantially parallel to the base of the light fixture and, in another aspect, the upper edge of the blade rib can be positioned substantially parallel to the base of the light fixture. In yet another aspect, the lower edge of each blade rib can be positioned substantially parallel to the ceiling plane when the louver assembly is mounted to the light fixture housing. In this aspect, it is contemplated that the lower edge of each of the blade ribs can be positioned in a common plane that can be, in one example, substantially co-planar with the ceiling plane.

Figure 3:
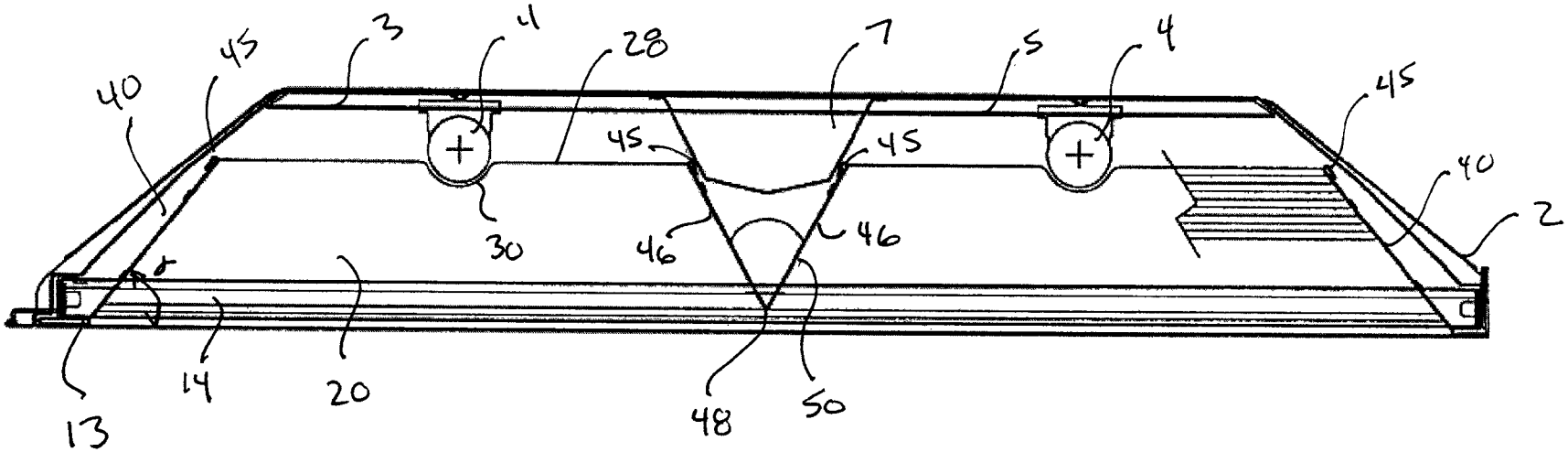
FIG. 3 is a partial broken cross-sectional view of the louver assembly of FIG. 2, taken across line 3-3 of FIG. 2.
Figure 8:
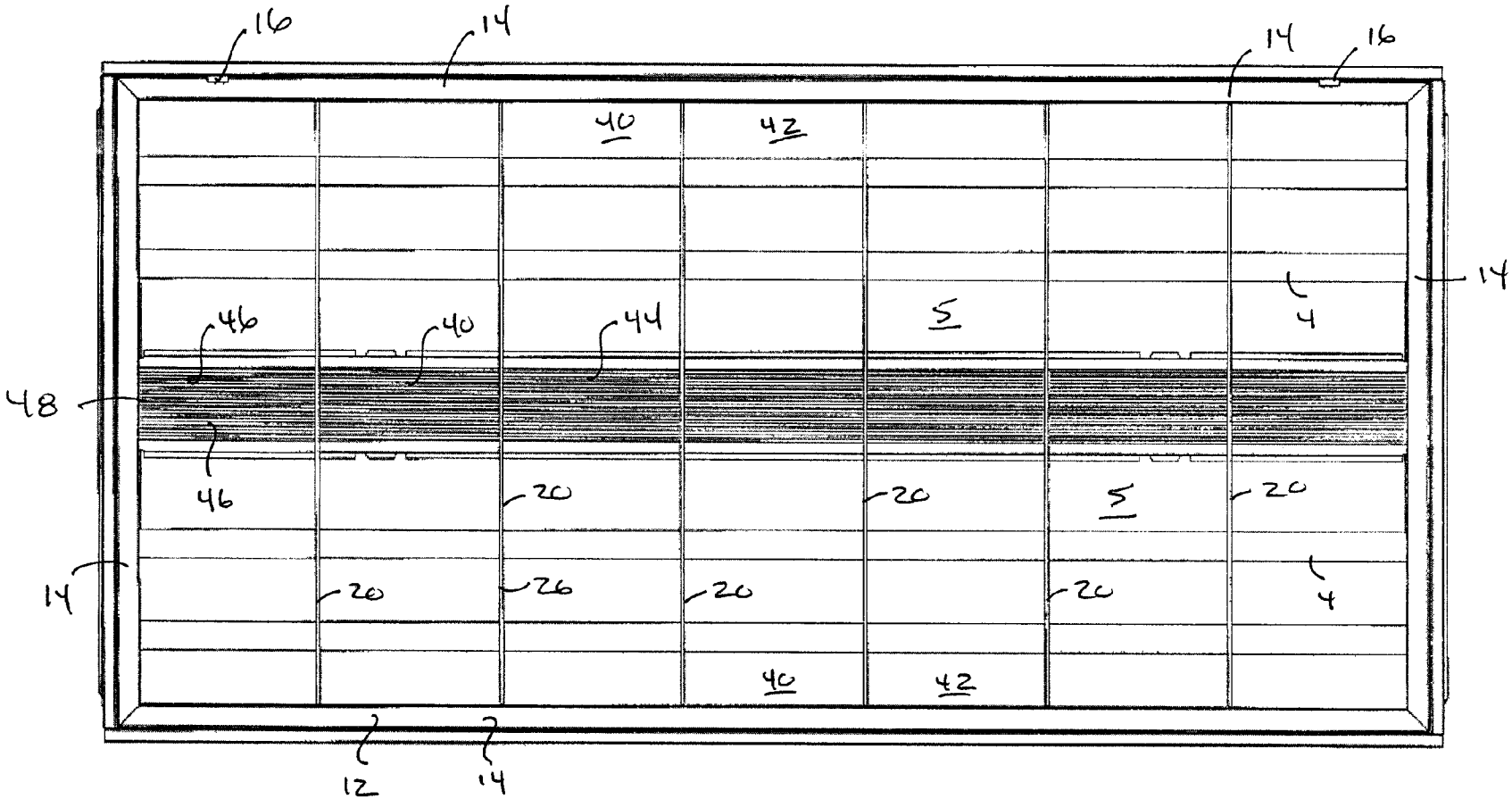
FIG. 8 is a bottom elevational view of the louver assembly of FIG. 7, shown disposed within the light fixture housing.
Figure 9:
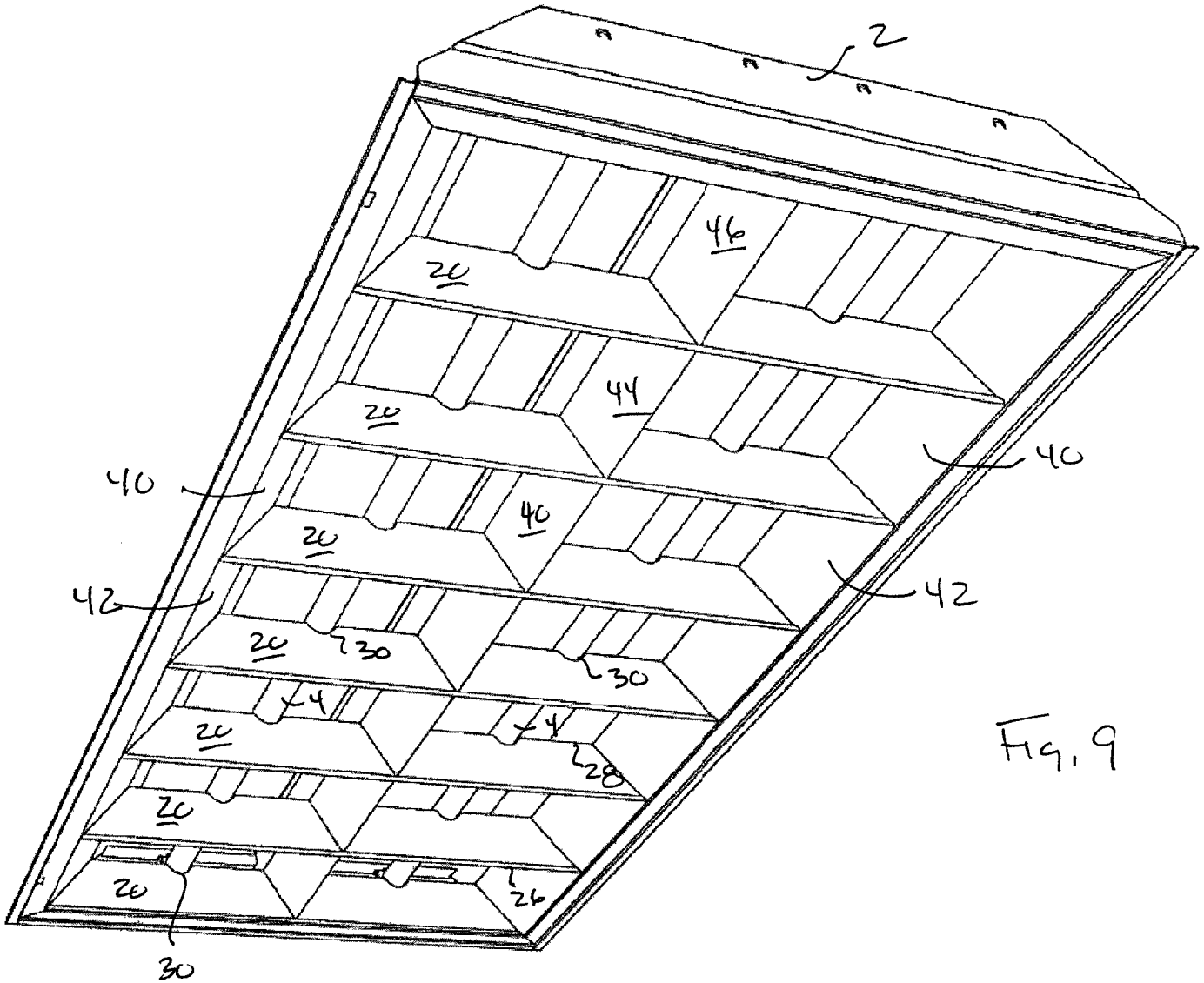
FIG. 9 is a perspective view of a louver assembly of the present invention shown disposed within a light fixture housing that is configured for mounting two lamp sources according to a third embodiment of the invention.
Figure 10B:
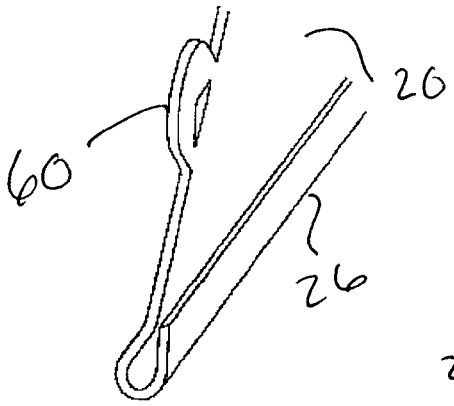
FIG. 10B is an enlarged perspective view of an end of the blade rib of FIG. 10A, showing the rolled lower edge.
Figure 10A:
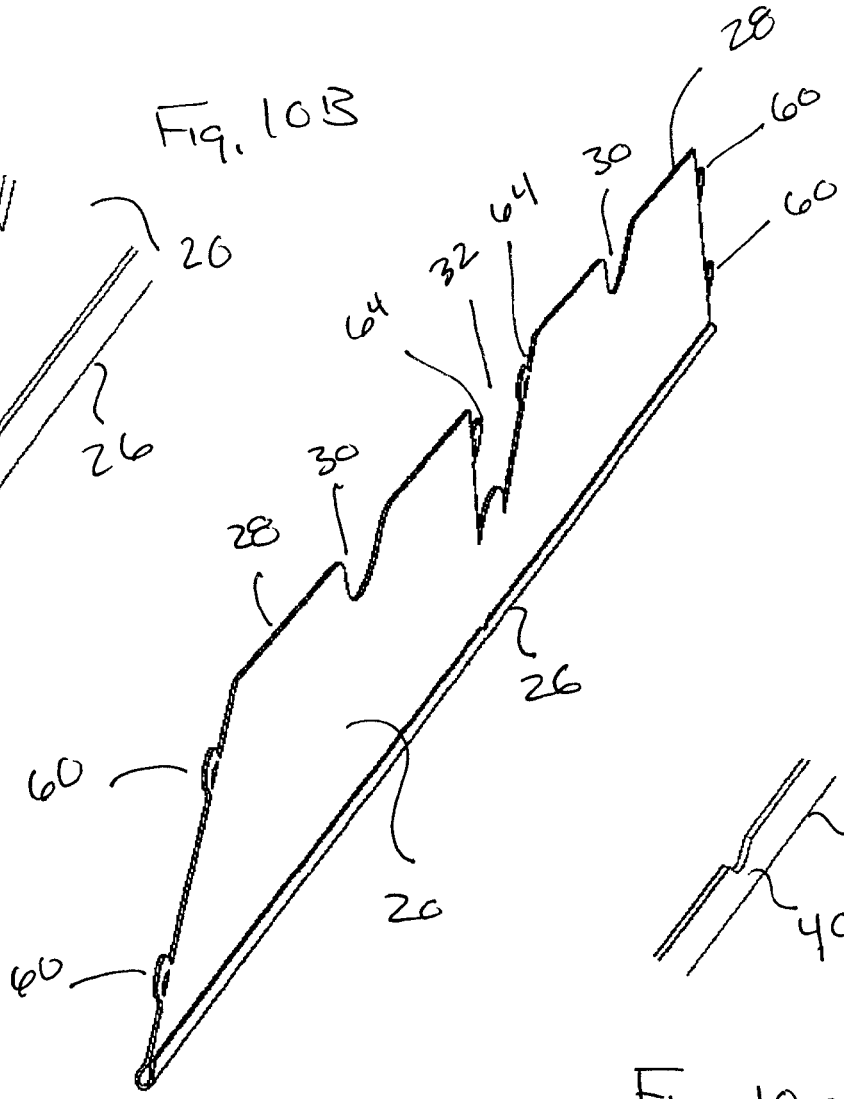
FIG. 10A is a perspective view of an exemplary blade rib of the louver assembly of FIG. 9, showing a rolled lower edge configured to increase the structural rigidity of the blade rib.
Figure 10C:
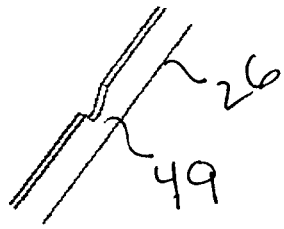
FIG. 10C is an enlarged perspective view of a center portion of the blade rib of FIG. 10A, showing a notch defined in a portion of the rolled lower edge of the blade rib
Figures 11A, 11B, 11C, 11D, 11E, 11F, 11G, 11H, 11I, 11J:
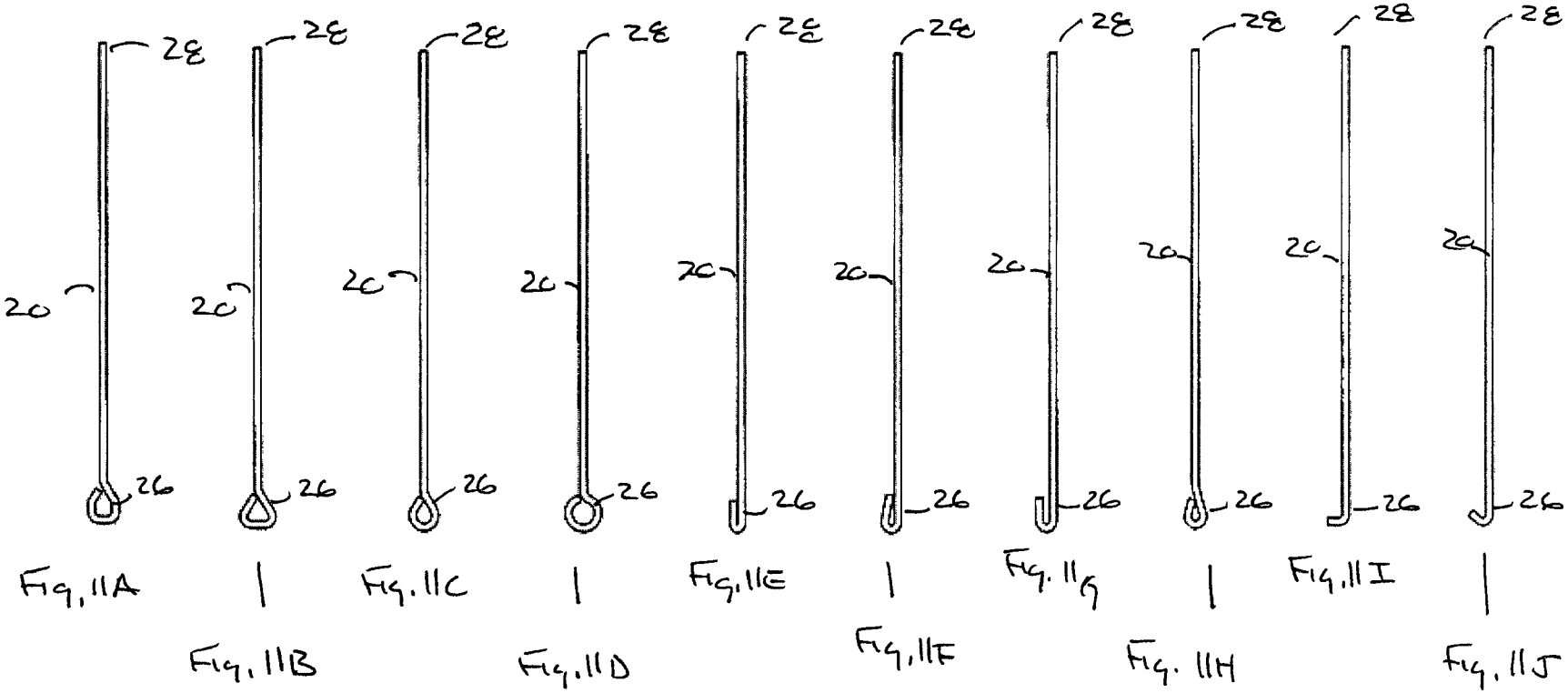
FIGS. 11A-11J are cross-sectional views of exemplary blade ribs of the louver assembly shown in FIG. 8A, showing alternative embodiments of the rolled lower edge of the blade rib.
Figures 12A, 12B, 12C, 12D, 12E, 12F, 12G, 12H, 12I, 12J:
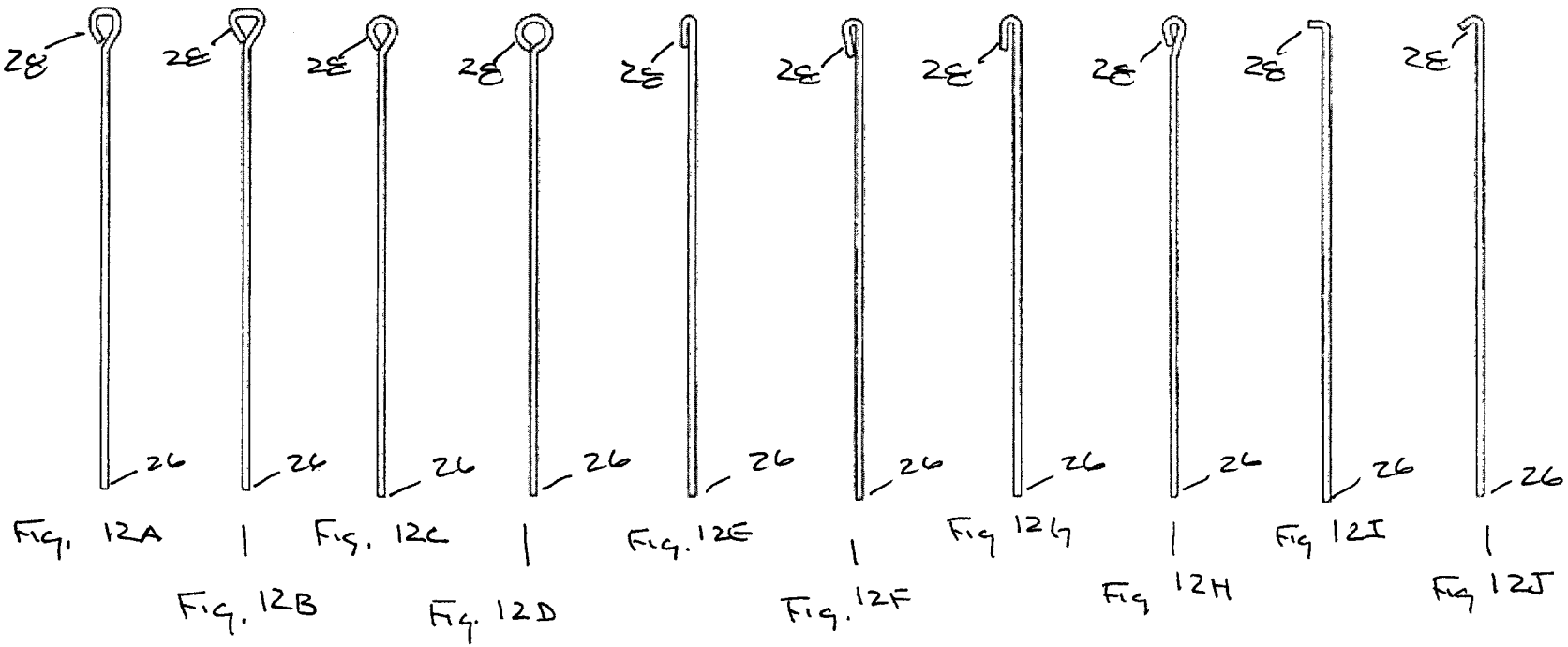
FIGS. 12A-12J are cross-sectional views of exemplary blade ribs of the louver assembly, showing alternative embodiments of the rolled upper edge of the blade rib.

In another aspect, a portion of the upper edge 28 of the blade rib can define at least one light source notch 30 that is configured to partially surround the light source 14. As shown in FIGS. 3 and 8A, in the exemplary embodiment with two elongated light sources, the upper edge 28 of each blade rib will define two light source notches 30 that are spaced to partially surround the substantially parallel light sources. In another aspect, the upper edge 28 of each blade rib of this embodiment can have a center notch 32 positioned intermediate the two respective light source notches 30.

In a further aspect, the plurality of stringers 40 comprises a pair of side stringers 42 and a center stringer 44. In one aspect, each side stringer 42 has a substantially planar shape. In another aspect, the center stringer 44 has a substantially V-shape in cross section with two tapered sides 46 that extend downwardly to a common apex edge 48. In one aspect, when the louver assembly is connected to the light housing, the open end of the center stringer is configured to overlie a ballast cover 7 of the light housing 2, which is typically longitudinally disposed in the center of the base of the light housing. Optionally, the tapered sides of the center stringer can generally match the angle of the respective sides of the ballast cover.

In a further aspect, the center stringer 44 defines a plurality of apex slots 50 that extend upwardly on each tapered side 46 from the apex 48. In one aspect, each apex slot 50 is oriented substantially transverse to the longitudinal axis of the center stringer.

Figure 4:
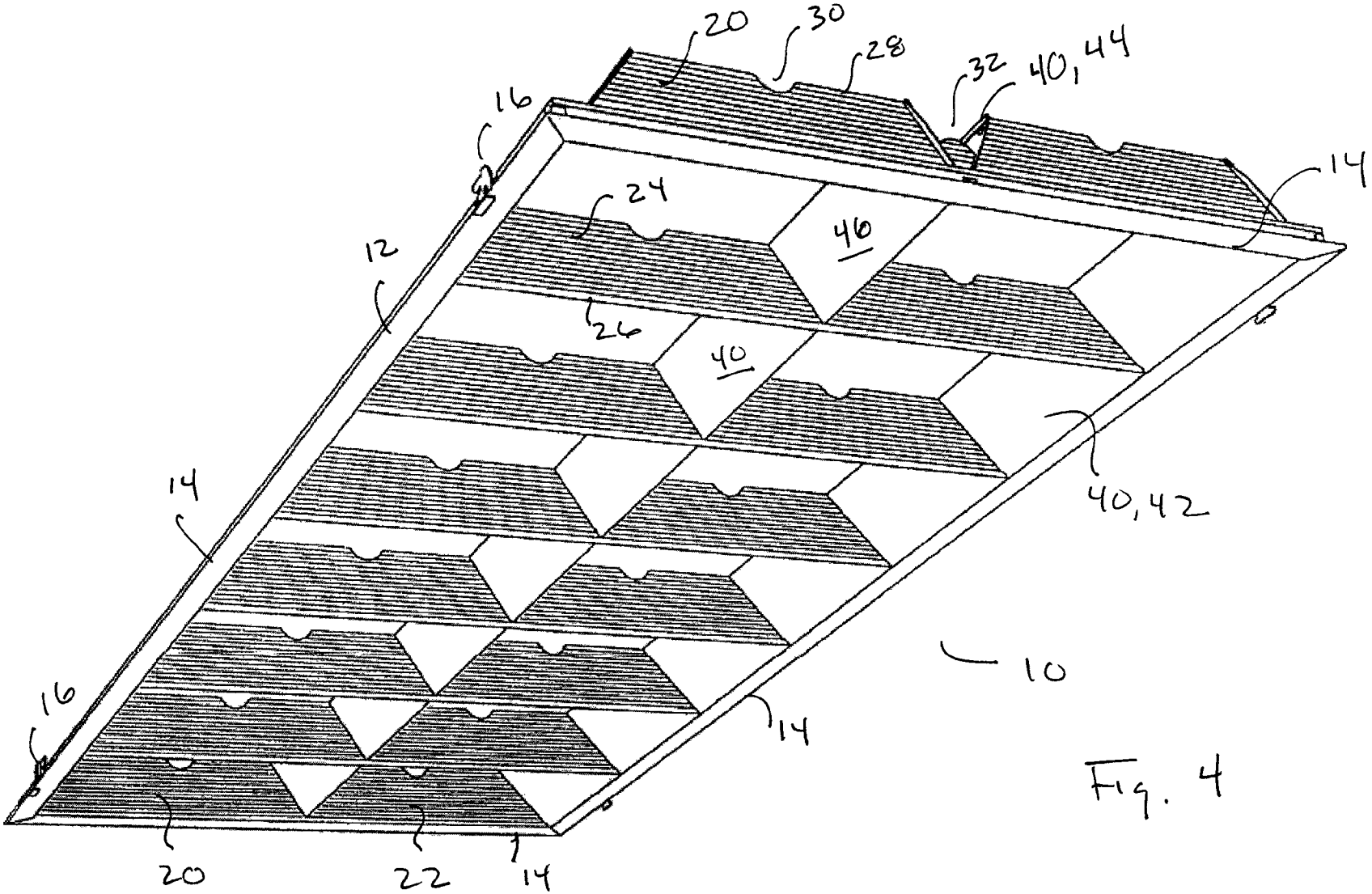
FIG. 4 is a bottom end perspective view of the louver assembly of FIG. 1.
Figure 5:
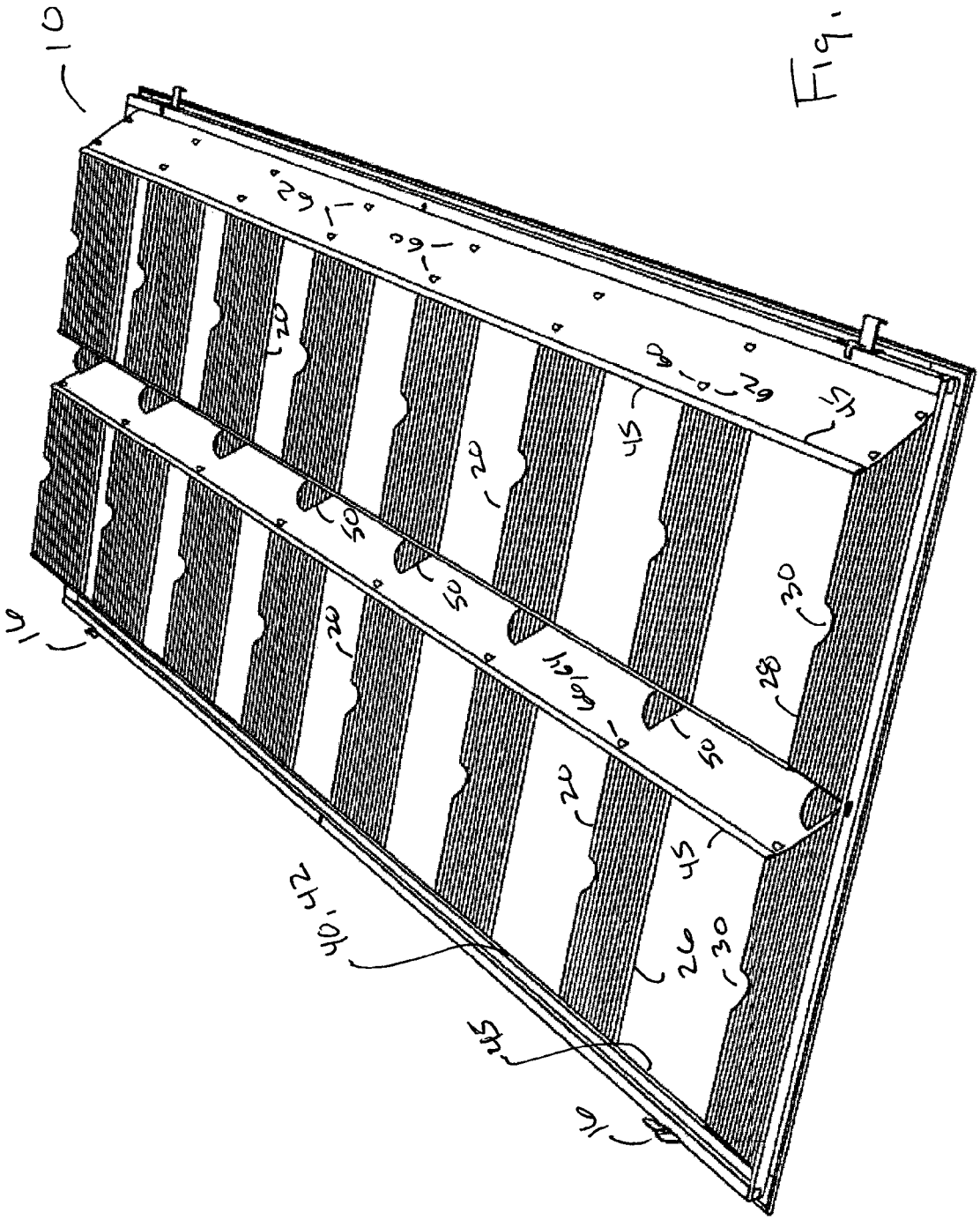
FIG. 5 is a top end perspective view of the louver assembly of FIG. 1.
Figure 6:
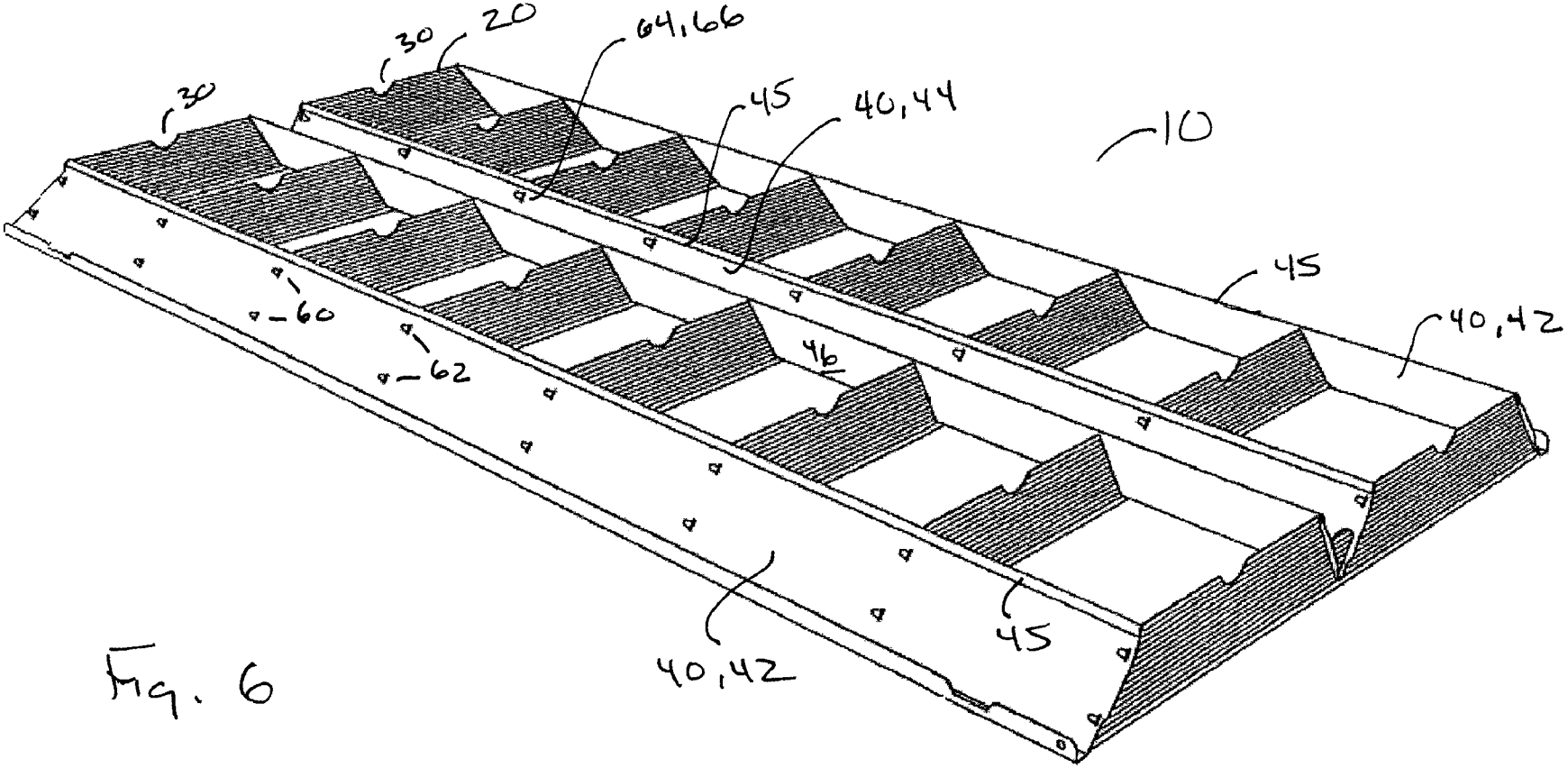
FIG. 6 is a top side perspective view of the louver assembly of FIG. 1.
Figure 7:
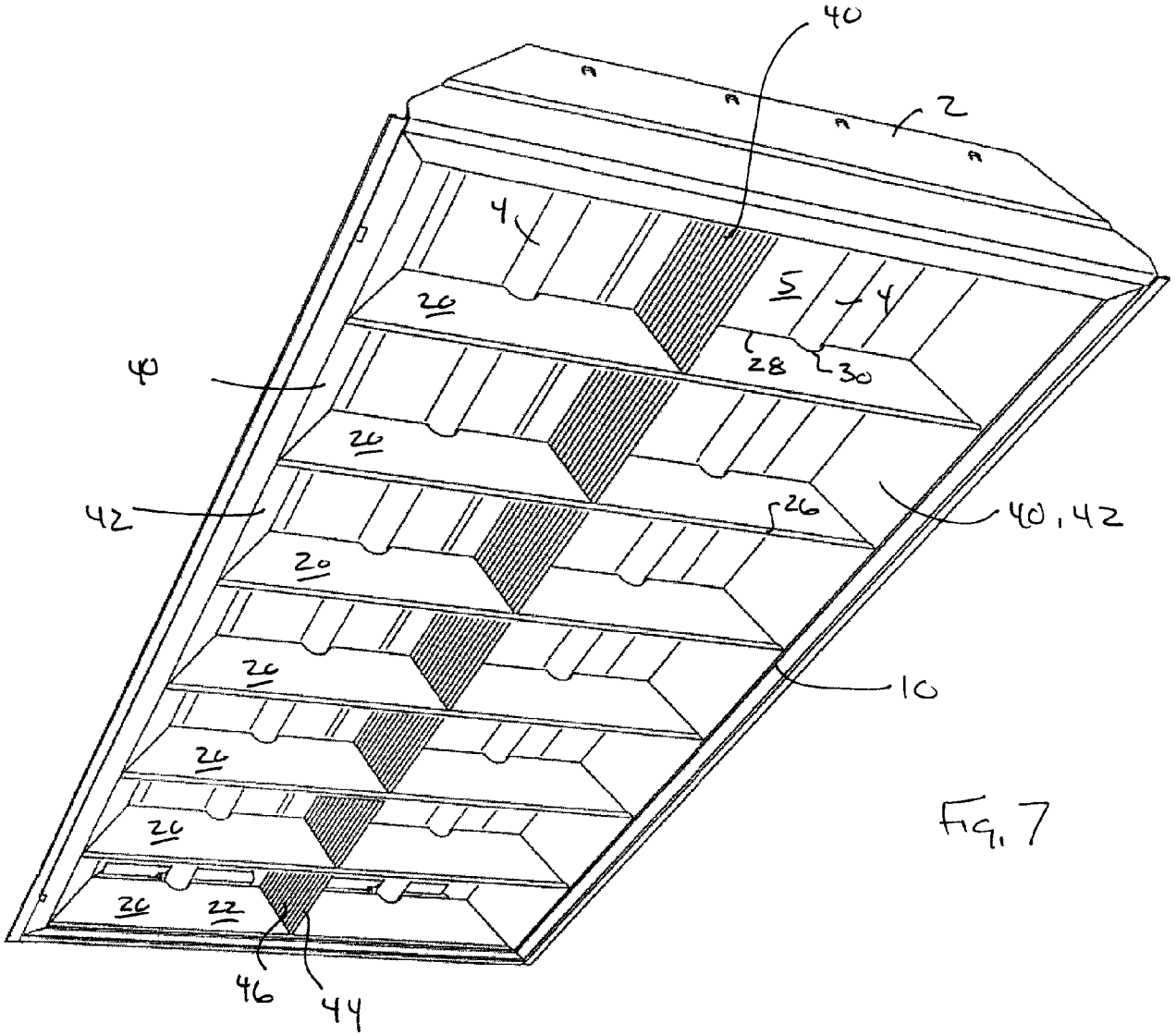
FIG. 7 is a perspective view of a louver assembly of the present invention shown disposed within a light fixture housing that is configured for mounting two lamp sources according to a second embodiment of the invention.

In one exemplary aspect shown in FIG. 4, the louver assembly 10 is formed by assembling the respective side stringers 42 and the center stringer 44 that extend in the longitudinal direction of the light fixture, with two end blade ribs 22 and five center blade ribs 24 that extend in the transverse direction. The two end blade ribs 22 form the respective end faces of the louver assembly and extend the substantial width of the interior cavity of the door frame 12. The respective side stringers 42 form the longitudinal edge faces of the louver assembly and, along with the center stringer 44, extend the substantial length of the interior cavity of the door frame. In one aspect, it is contemplated that both the stringers 40 and the blade ribs 20 extend upwardly to a depth that, when mounted therein the light fixture, the upper edge 28 of the blade ribs 20 and the top edge 45 of the stringer members 40 extend above a plane that extends substantially parallel to the ceiling plane and that bisects a bottom portion of the at least on light source 4.

Of course, it is contemplated that various size louver assemblies 10 may be used constructed to fit light fixture housings 2 of differing size by varying the number of longitudinal stringers and transverse blade ribs that comprise the louver assembly, along with their dimensions. In this fashion, it is contemplated that the louvers can be formed in an array of cells as desired. For example, the exemplified louvers illustrated in the present application are for a 14 cell louver in a 7 cell×2 cell array. It is contemplated that the array of cells for the louver can be selected as desired, such as, for example and not meant to be limiting, a 12 cell louver in a 6 cell×2 cell array.

In one exemplary aspect, the blade ribs are mounted therein a channel defined in support members of the door frame 12 and the respective stringers are mounted and fixed to the respective blade ribs. In a further aspect, tabs can be used to secure the blade ribs 20 and the respective stringers 40 to each other. In one exemplary aspect, at least one end tab 60 can extend outwardly from each of the respected ends of the blade rib 20. These end tabs are inserted into slots 62 defined thereon the two opposing side stringers. Further, at least one outwardly extending tab 64 can be defined on upper portions of the central notch of the blade rib that are configured to be received within slots 66 defined above the apex slot of the center stringer. Further, it is contemplated that at least a portion of the blade rib can be inserted into the apex slot of the center stringers. The respective tabs 60, 64 are bent or folded-over such that the respective stringers and blades are substantially fixed in relation to each other.

In one aspect, when the stringers and blade ribs are positioned, the respective side surfaces of the stringers are oriented at an acute angle relative to the plane of the door frame. Thus, the respective surfaces of the stringers face downwardly to reflect incident light emitted by the respective light sources downwardly into the room. Further, the reflective surfaces, i.e., the front and back reflective faces of the connected blade ribs 20, are positioned substantially upright and generally transverse to the ceiling plane.

Thus, in the illustrated embodiment, the outer periphery of the louver assembly is substantially defined by the two side stringers 42, which extend in the longitudinal direction, and the two end blade ribs 32, which extend in the transverse direction. Referring to FIGS. 9-11J, in one aspect, at least a portion of the lower edge 26 of each blade rib comprises a rolled edge. In another aspect, as shown in FIGS. 12A-12J, at least a portion of the upper edge 28 of each blade rib comprises a rolled edge. In a further aspect, at least a portion of the top edge 43 of each stringer comprises a rolled edge. It will be appreciated that forming a rolled edge on the respective lower or upper edge 26, 28 of each blade rib and/or the top edge 45 of each stringer increases their structural rigidity, which reduces deflection and bowing of the respective blade ribs 20 and stringers 40. Alternative embodiments of the rolled lower edge 26 of the blade rib are shown in FIGS. 11A-11J and alternative embodiments of the rolled upper edge 28 of the blade rib are shown in FIGS. 12A-12J.

In another aspect, when the stringers and blade ribs are connected together, the bottom edge of at least one stringer member of the plurality of stringer member is recessed above the lower edges of the plurality of blade ribs. A notch 49 can be defined in a portion of the rolled lower edge 26 of the blade rib that is configured to cooperate with the common apex edge of the center stringer. In this aspect, the common apex edge and the lower edges of the plurality of blade ribs can be positioned in or proximate to a substantially common plane.

In one aspect, the rolled lower edge 26 of the blade rib provides for damage resistance and increased strength that allows for general planar construction with increased optical efficiency over conventional V formed cross blades. The flat, substantially upright, blade ribs 20 of the present invention increases optical efficiency of the light fixture because the subtended angle is reduced over the conventional V-shaped or parabolic-shaped cross blade louver designs. In another aspect, the rolled lower edge 26 of the blade rib 20 provides a visual thickness that enhances the louver assembly's integrity and quality.

In a further aspect, the light source notches 30 formed in the upper edge of the blade rib allows for the use of a taller blade rib which yields a deeper louver appearance as well as providing superior off-axis shielding. In yet another aspect, the light source notches 30 also allow the light source(s), such as the exemplified elongate lamps, to be positioned lower in the light fixture than would be otherwise possible. Having the lamp(s) positioned lower in the fixture, i.e., closer to the opening of the fixture and the ceiling plane, acts to enhance the overall light fixture efficiency.

In a further aspect of the invention, referring to FIGS. 1-9, each blade rib 20 can be at least partially corrugated. In another aspect, each stringer 40 can be at least partially corrugated. In various exemplary aspects, it is contemplated that a select one or all off the respective blade ribs and stringers of the louver assembly can be corrugated. In one aspect, corrugation of the blade ribs 20 and/or stringers 40 provides material strength and resistance to bending. As one skilled in the art will appreciate, this allows for the use of thinner materials than would normally be required. Further, the corrugation of the blade ribs and/or stringers provides material variation yielding an upscale appearance and luminance gradient changes in parallel bright and dark bands to lower perceived brightness. Additionally, the corrugation pattern reduces specular reflections and yields a smooth uniform blade appearance. The pattern also serves to disguise any blade rib and/or stringer imperfections. In a further aspect, the portion of the blade ribs proximate the rolled edge is not corrugated so that the forming consistency of the rolled edge embodiment is increased.

In addition, one skilled in the art understands that if a single light source 4 is utilized, the louver assembly 10 would comprise the pair of side stringers 42 and the plurality of blade ribs 20 as the center stringer 44 is not necessary in this embodiment. Further, the blade rib would only need to define a single light source notch in the upper edge of the blade rib as the central notch 32 is not required.

The stringers and blade ribs which comprise louver assembly 10 are preferably made from a lightweight, thin metal or ultra-thin material, such as aluminum or steel. In one aspect, it is preferred to use steel to form the respective blade ribs and/or stringers of the louver assembly to both provide strength and damage resistance. Further, the use of steel materials allows for the manufacture of substantially planar blade ribs with their optical efficiency advantages. In another aspect, the use of steel materials yields economic advantages over the use of more traditional aluminum.

In another aspect, the design of the louver assembly of the present invention promotes the use of powder paint finishing yielding high reflectivity, field cleanability and/or dirt resistance. The design also allows for the use of paint after assembly finishing processes with its attendant economic advantages in the market verses requiring painting before assembly.

It is contemplated that the louver assembly of the present invention can be sized and shaped to fit into existing high volume fixture and door frame components. As noted above, the louver assembly also provides economic advantages in regard to material content, shipping and storage efficiencies, and installation and performance enhancements to the end user.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

We claim:

1. A louver assembly for use in a light fixture housing mounted in a ceiling plane, the light fixture housing having a base and at least one light source mounted therein, comprising:

a plurality of stringers extending in a longitudinal direction, each stringer of said plurality of stringers comprising at least one longitudinally extending side surface, wherein at least one side surface of each stringer of the plurality of stringers is positioned at an acute angle with respect to the ceiling plane; and a plurality of substantially planar blade ribs connected to the plurality of stringers and extending substantially transverse to the plurality of stringers, each blade rib of said plurality of blade ribs comprising a front reflective face and an opposed back reflective face, wherein at least a portion of an edge of each blade rib of the plurality of blade ribs comprises a rolled edge, and wherein the plurality of blade ribs are positioned substantially transverse with respect to the ceiling plane.

2. The louver assembly of claim 1, wherein a lower edge of each blade rib of the plurality of blade ribs is positioned substantially parallel to the ceiling plane.

3. The louver assembly of claim 1, wherein a lower edge of each blade rib of the plurality of blade ribs is positioned substantially coplanar.

4. The louver assembly of claim 3, wherein the lower edges of the plurality of blade ribs are substantially coplanar with the ceiling plane.

5. The louver assembly of claim 1, wherein a bottom edge of at least one stringer of the plurality of stringers is recessed above the lower edges of the plurality of blade ribs.

6. The louver assembly of claim 1, wherein the plurality of blade ribs comprises two end blade ribs and a plurality of center blade ribs.

7. The louver assembly of claim 6, wherein the end blade ribs and center blade ribs are substantially identical.

8. The louver assembly of claim 2, wherein an upper edge of each blade rib is positioned proximate a portion of the base of the light fixture housing.

9. The louver assembly of claim 2, wherein an upper edge of each blade rib is positioned substantially parallel to the base of the light fixture housing.

10. The louver assembly of claim 9, wherein a portion of the upper edge of at least one blade rib defines at least one light source notch that is configured to partially surround the at least one light source.

11. The louver assembly of claim 9, wherein the at least one light source comprises at least one elongate light source, and wherein a portion of the upper edge of each blade rib defines at least one light source notch that is configured to partially surround the at least one elongate light source.

12. The louver assembly of claim 11, wherein the at least one elongate light source comprises a pair of substantially parallel light sources, and wherein portions of the upper edge of each blade rib define a pair of spaced light source notches configured to partially surround the pair of substantially parallel light sources.

13. The louver assembly of claim 12, wherein the upper edge of each blade rib defines a center notch.

14. The louver assembly of claim 13, wherein the center notch is positioned intermediate the pair of spaced light source notches.

15. The louver assembly of claim 1, wherein the plurality of stringers comprises a pair of side stringers and a center stringer.

16. The louver assembly of claim 15, wherein each side stringer has a substantially planar shape.

17. The louver assembly of claim 15, wherein the center stringer has a V-shape in cross-section with two tapered sides that extend downwardly to a common apex edge.

18. The louver assembly of claim 17, wherein the center stringer defines a plurality of apex slots that extend upwardly on each tapered side of the center stringer from the common apex edge.

19. The louver assembly of claim 18, wherein each apex slot is oriented substantially transverse to the longitudinal axis of the center stringer.

20. The louver assembly of claim 18, wherein at least a portion of one blade rib is configured to be inserted into the apex slot of the center stringer.

21. The louver assembly of claim 18, wherein the upper edge of each blade rib defines a center notch, and wherein the center notch of one blade rib is configured to be inserted into one apex slot of the center stringer.

22. The louver assembly of claim 1, wherein each stringer of the plurality of stringers defines a plurality of slots, wherein each blade rib of the plurality of blade ribs defines a plurality of tabs that extend outwardly from edge portions of the blade ribs and that are configured to be operatively received within respective slots in the plurality of stringers such that respective stringers are substantially fixed to the respective blade ribs.

23. The louver assembly of claim 1, wherein an upper edge of the blade ribs and a top edge of the stringers extend above a plane that extends substantially parallel to the ceiling plane and that bisects a bottom portion of the at least one light source.

24. The louver assembly of claim 1, further comprising a planar door frame that comprises a plurality of elongate support members that are connected together to form the door frame.

25. The louver assembly of claim 24, further comprising means for releaseably securing the louver assembly to the light fixture housing.

26. The louver assembly of claim 24, wherein each support member of the plurality of support members has an edge portion, and further comprising a plurality of spring clips that are configured to mount to edge portions of the support members for releaseably securing the louver assembly to the light fixture housing.

27. The louver assembly of claim 24, wherein the support members of the door frame define a channel, and wherein end portions of the blade ribs are mounted therein the channel.

28. The louver assembly of claim 1, wherein at least a portion of a lower edge of each blade rib comprises a rolled edge.

29. The louver assembly of claim 1, wherein at least a portion of a top edge of each stringer comprises a rolled edge.

30. The louver assembly of claim 1, wherein each blade rib is at least partially corrugated.

31. The louver assembly of claim 1, wherein each stringer is at least partially corrugated.

32. The louver assembly of claim 1, wherein at least a portion of a select one or all of the respective blade ribs and stringers of the louver assembly is corrugated.

33. The louver assembly of claim 32, wherein a portion of each blade rib proximate the lower edge of the blade rib is not corrugated.

34. The louver assembly of claim 1, wherein the stringers and blade ribs comprise aluminum or steel.

35. The louver assembly of claim 1, further comprising means for reducing a subtended angle to increase optical efficiency, wherein the means for reducing the subtended angle comprises positioning the reflective surfaces of the plurality of blade ribs substantially upright and substantially transverse to the ceiling plane.

36. The louver assembly of claim 1, wherein a plane bisecting the rolled edge of each blade rib is substantially parallel to the blade rib.

37. A louver assembly for use in a light fixture housing mounted in a ceiling plane, the light fixture housing having a base and at least one light source mounted therein, comprising:

a plurality of stringers extending in a longitudinal direction, each stringer of said plurality of stringers comprising at least one longitudinally extending side surface, wherein at least one side surface of each stringer of the plurality of stringers is positioned at an acute angle with respect to the ceiling plane; and a plurality of substantially planar blade ribs connected to the plurality of stringers and extending substantially transverse to the plurality of stringers, wherein the plurality of blade ribs are positioned substantially transverse with respect to the ceiling plane, wherein at least a portion of an edge of each blade rib of the plurality of blade ribs comprises a rolled edge, and wherein an upper edge of the blade ribs and a top edge of the stringers extend above a plane that extends substantially parallel to the ceiling plane and that bisects a bottom portion of the at least one light source.

38. A louver assembly for use in a light fixture housing mounted in a ceiling plane, the light fixture housing having a base and at least one light source mounted therein, comprising:

a plurality of stringers extending in a longitudinal direction, each stringer of said plurality of stringers comprising at least one longitudinally extending side surface, wherein at least one side surface of each stringer of the plurality of stringers is positioned at an acute angle with respect to the ceiling plane;

a plurality of substantially planar blade ribs connected to the plurality of stringers and extending substantially transverse to the plurality of stringers, wherein at least a portion of an edge of each blade rib of the plurality of blade ribs comprises a rolled edge; and means for reducing a subtended angle to increase optical efficiency, wherein the means for reducing the subtended angle comprises positioning the reflective surfaces of the plurality of blade ribs substantially upright and substantially transverse to the ceiling plane.

39. A louver assembly for use in a light fixture housing mounted in a ceiling plane, the light fixture housing having a base and at least one light source mounted therein, comprising:

a plurality of stringers extending in a longitudinal direction, each stringer of said plurality of stringers comprising at least one longitudinally extending side surface, wherein at least one side surface of each stringer of the plurality of stringers is positioned at an acute angle with respect to the ceiling plane; and a plurality of substantially planar blade ribs connected to the plurality of stringers and extending substantially transverse to the plurality of stringers, wherein at least a portion of an edge of each blade rib of the plurality of blade ribs comprises a rolled edge, wherein the plurality of blade ribs are positioned substantially transverse with respect to the ceiling plane, wherein at least a portion of a select one or all of the respective blade ribs and stringers of the louver assembly is corrugated.

* * * * *